United States Patent [19]

Engelhaupt

[11] Patent Number: 4,484,842

[45] Date of Patent: Nov. 27, 1984

[54] APPARATUS AND METHOD FOR CENTRALLY INSTALLING A SHORING COLUMN INTO A PREDRILLED GROUND HOLE

[75] Inventor: Bernd Engelhaupt, Heinsberg, Fed. Rep. of Germany

[73] Assignee: Josef Krings, Heinsberg-Oberbruch, Fed. Rep. of Germany

[21] Appl. No.: 453,908

[22] Filed: Dec. 28, 1982

[30] Foreign Application Priority Data

Dec. 30, 1981 [DE] Fed. Rep. of Germany ..... 31518567

[51] Int. Cl.[3] ..... E02D 13/04

[52] U.S. Cl. ..... 405/232; 405/272; 405/282

[58] Field of Search ..... 405/133, 142, 232, 239, 405/247, 267, 272, 282

[56] References Cited

U.S. PATENT DOCUMENTS

| | | | |
|---|---|---|---|
| 2,488,073 | 11/1949 | Thornley et al. | 405/239 |
| 3,008,691 | 11/1961 | Steele et al. | 405/232 X |
| 3,283,519 | 11/1966 | Rusche | 405/247 |
| 3,412,562 | 11/1968 | Doughty | 405/267 |

*Primary Examiner*—David H. Corbin

*Attorney, Agent, or Firm*—Larson and Taylor

[57] ABSTRACT

An apparatus and method for centrally installing a shoring column into a predrilled hole includes a ring-shaped supporting structure which fits into the hole and includes a central opening large enough for the column. Clamp elements attached to the supporting structure clamp the column. A plurality of centralizing piston and cylinder units attached to the supporting ring extend outwardly to engage the side of the ground hole to centralize the support structure and column in the hole. The elements associated with the supporting structure are controlled remotely from control elements located at ground level outside of the ground hole.

11 Claims, 6 Drawing Figures

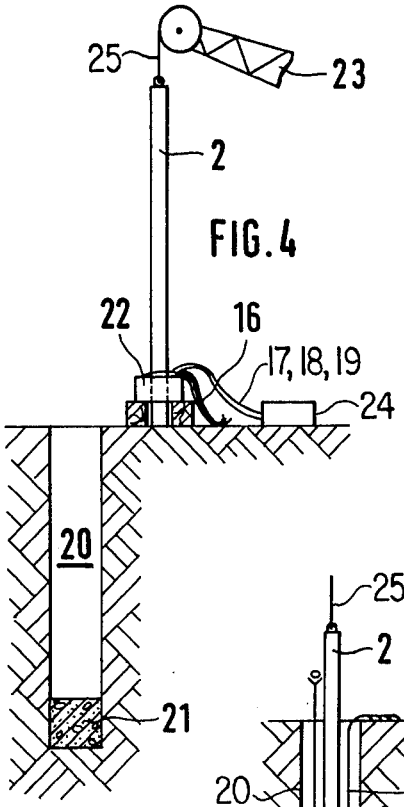
FIG. 4
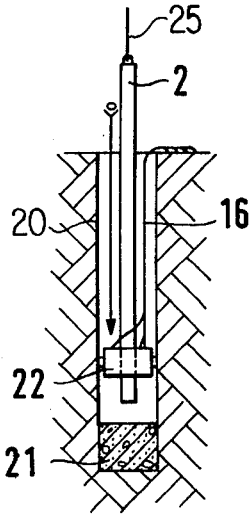
FIG. 5
FIG. 6
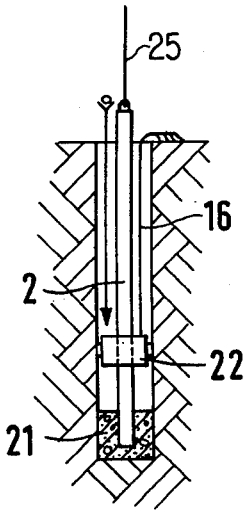

APPARATUS AND METHOD FOR CENTRALLY INSTALLING A SHORING COLUMN INTO A PREDRILLED GROUND HOLE

This invention relates to a system for centrally installing a shoring column into a predrilled ground hole.

As is known heretofore, in the so called tie-back shoring system, also known as the "Berlin shoring system", the beams or shoring columns of the supporting timbered walls are driven into predrilled ground holes which are typically approximately 10 meters deep.

In these known systems, it was generally necessary that the supporting timbered walls be cut to size on the job sight because, as a rule, it was extremely difficult to arrange the spacing between the columns with sufficient precision so that prefabricated shoring columns could be used. Hence, in the past only timber boards could be used as a material for shoring, and this in turn required that a larger number of columns be used, thus making this shoring system relatively expensive.

Another previously attempted tie-back system used reinforced concrete slabs or the like which had to be set between channels and built up as columns. However, this system did not prove successful because this type of shoring system required that the shoring board be wedged against the columns and required large tolerances in the horizontal spacing and the columns needed oversized flanges to accommodate these tolerances. In addition, these systems were labor-intensive because the wedging of the boards against the columns had to be done manually, requiring that the construction personnel work under hazardous conditions in the unprotected excavations.

The object of the present invention is to utilize a technique normally used in trench construction and applying the same to a method and apparatus for erecting shoring columns in large excavations. The shoring columns are generally equipped with interlocking guides which create a reusable bracing system.

To achieve the object of the present invention, it is necessary that the shoring column be set in the predrilled ground hole with precision so that proper vertical alignment, i.e. plumbness is assured. Techniques for drilling ground holes are presently sufficiently developed that it can be assumed that the spacings between the predrilled ground holes can be kept within desired limits. An important aspect of the present invention is that it provides for erecting the shoring columns centrally within the predrilled ground holes, i.e. it assures that within each predrilled ground hole, the shoring column is maintained at an equal distance from the sides of the predrilled ground holes in each of the columns.

The object of the present invention is achieved by providing a method and apparatus for centrally installing a shoring column into a predrilled ground hole, wherein a ring-shaped supporting structure includes therein a clamping means for clamping the shoring column and a plurality of centralizing piston and cylinder units which extend outwardly from the ring-shaped supporting structure to properly locate and centralize the ring, and hence also the shoring column, within the ground hole. The clamping means and centralizing piston and cylinder units are controlled remotely from control means located exterior to the predrilled ground holes.

The ring-shaped supporting structure is attached near the base of the prefabricated shoring column and subsequently set into the ground hole therewith. When the column reaches the bottom of the ground hole, such that the lower end thereof is received within a foundation compound, the centralizing piston and cylinder units are activated to radially adjust the supporting structure and hence also the column within the ground hole. The correct vertical position of the column can be assured by using suitable alignment devices such as a laser beam. Thereafter, the column is set, for example, in the foundation compound which may be placed on top of a concrete foundation, mortar pad or the like.

If at a later time the need arises to remove the shoring column, this can be accomplished with suitable measures such as by separating the column base from the foundation. However, such techniques do not form a part of the present invention.

The method and apparatus of the present invention provide the advantage of permitting the use of shoring columns utilizing positive fit prefabricated shoring plates in which a fixed position of the plates is achieved in a direction which is both normal to the surfaces of the plates and along their vertical spans. The invention will therefore eliminate the need for wedging the shoring plates and thereby also eliminate the expensive, labor-intensive and hazardous working conditions which were necessary using previous shoring systems utilizing horizontal members in unprotected excavations. With the present invention, it is also possible to work with large spans between the columns and thus, with fewer columns and hence with fewer ground holes. This results in further economies and reduced construction time. In addition, with the present invention the shoring materials can be used repeatedly, while using less personnel. This was not feasible in previous shoring systems in which the shoring materials were frequently left in the ground.

The present invention will now be described with reference to the accompanying drawings in which: FIG. 1 is a side view of the shoring apparatus of the present invention, partially in cross section and partially in side elevation, taken along line I—I of FIG. 2.

FIGS. 4–6 are schematic horizontal sectional views illustrating three separate stages in utilizing the apparatus of the present invention to carry out the method of the present invention.

Referring now to the drawings, like elements are represented by like numerals throughout the several views.

Figure 1:
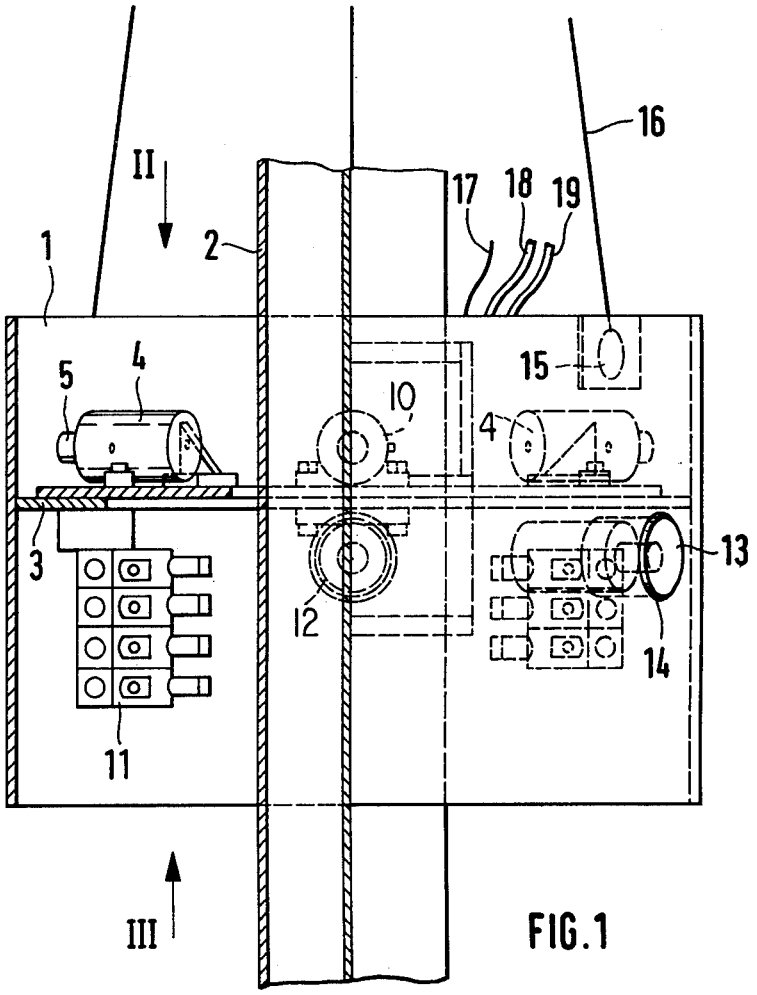

The shoring system of the present invention comprises a ring-shaped supporting structure 1 having an outside diameter slightly smaller than the inside diameter of the predrilled ground hole at the job sight. Attached to the interior of the supporting structure in an operating platform 3 which extends inwardly, but leaving a central opening larger in diameter than the largest cross section of the shoring column 2 which is to be driven into the ground hole.

The operating platform 3 has mounted thereon a plurality of hydraulically operated piston and cylinder units 4 (preferably an odd number of such units) which are arranged such that the pistons 5 thereof are extendible in a radial direction through an opening 6 outwardly of the ring-shaped structure 1 such that the pistons can engage the surrounding wall of the ground hole. A second set of piston and cylinder units 12 are mounted beneath the operating platform 3, each unit having a piston 13 arranged to extend in a radial direction outwardly through an opening 14 in the side wall of the supporting structure 1 so as to engage the side of the ground hole. Preferably, an odd number of such piston and cylinder units 12 are also provided. Preferably also these units are located, taken in the circumferential direction, midway between the respective piston and cylinder units 4. In operation, the piston and cylinder units 13 would be used for preliminary centralizing of the supporting structure 1 while the piston and cylinder units 5 would serve to provide a more precise, fine centralizing of the ring-shaped structure 1.

The operating platform 3 also has mounted thereon a clamping means for clamping the shoring column 2. The clamping means includes a pair of clamping elements. One of these clamping elements is an adjustable positive stop 8 which is adjustable in a radial direction by means of slotted holes 7 so as to positively grip one side of the shoring column 2. Opposing the positive stop 8 there is provided a further clamping element in the form of a hydraulically operated clamping piston 9 movable within a cylinder 10 which is mounted on the operating platform 3.

Mounted beneath the operating platform 3 there is provided a control unit 11 which, subject to control from means located outside of the drill hole, feeds hydraulic fluid to and receives hydraulic fluid from the individual piston and cylinder units 4, 10 and 12.

The supporting structure 1 has at its upper end eyes 15 in which engage holding ropes 16. Additionally, as shown schematically in FIG. 1, electrical energy supply cable 17 and hydraulic lines 18 and 19 extend upwardly from their appropriate connections within the supporting structure 1 to remote control means located on the surface outside of the ground holes.

FIGS. 4–6 illustrate the method of operation of the system according to the present invention.

Figure 2:
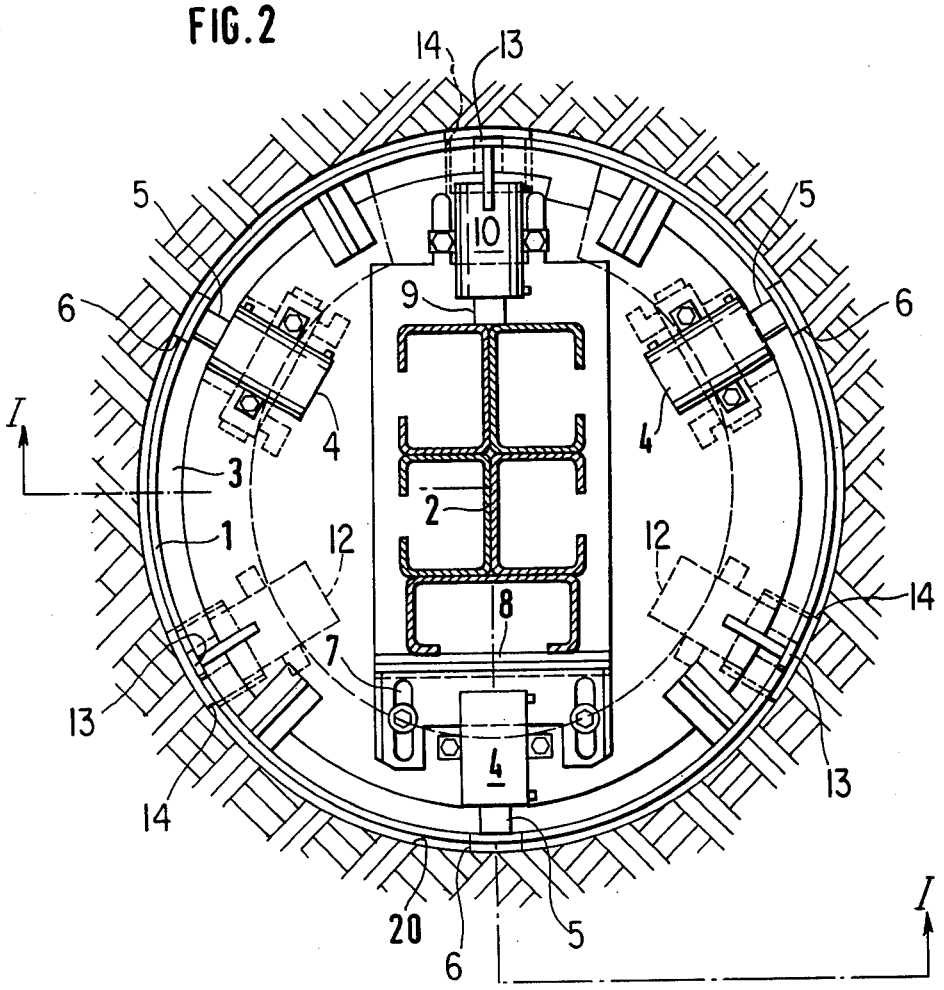
FIG. 2 is a top plan view, taken in the direction of the arrow II of FIG. 1.
Figure 3:
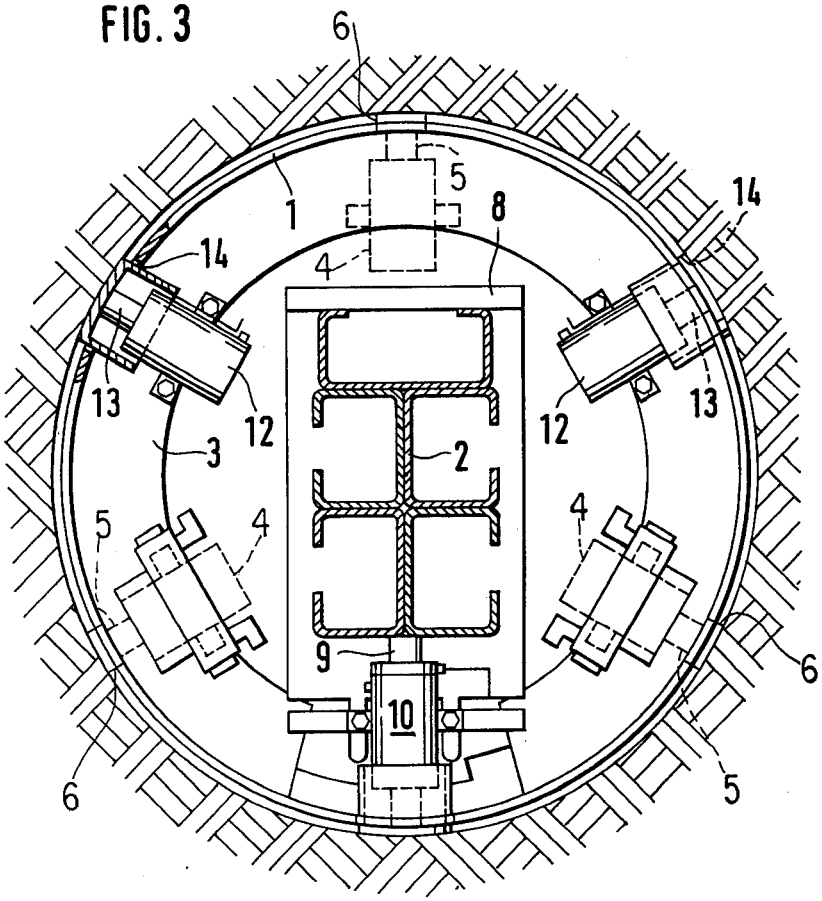
FIG. 3 is a bottom plan view looking upwardly towards the installation of FIG. 1, taken in the direction of the arrow III of FIG. 1.

Referring to FIG. 4, after a predrilled ground hole 20 is formed, a suitable foundation compound 21 is placed at the lower end thereof, preferably on top of approximately 50 cm of high wooden planks or the like. At this time the shoring column 2 is positioned on a block with the system 22, which represents the structure shown in FIGS. 1–3, placed about the shoring column 2 near the lower end thereof. Meanwhile, the upper end of shoring column 2 is secured by rope 25 to the hoisting machine 23. Also shown in FIG. 4 is the remote control means 24 which is connected through lines 17, 18 and 19 to the appropriate structures within the system 22. During the stage shown in FIG. 4, the clamping means, including clamping elements 8 and 9 would be suitably positioned against the sides of the shoring column 2. Also, at this stage the pistons 5 and 13 are retracted so that they are essentially coincident with the outer boundry of the supporting structure 1.

The shoring column 2, with the system 22 attached thereto, is then lowered into the ground hole 20, as shown in FIG. 5, until the lower end of the column 2 is received within the foundation compound 21.

The preliminary centralizing piston and cylinder units 12 are then operated to extend pistons 13 to provide a preliminary adjustment of the ring within the predrilled ground hole. The other set of piston and cylinder units 4 are then operated to extend the pistons 5 to provide a more refined adjustment of the supporting structure 1 within the ground hole 20.

As the column 2, with the system 22 attached thereto, is lowered into the hole 20, the holding ropes 16 are stretched out sideways away from the supporting structure 1. After the column 2 is securely in place, the supporting structure 1 may be removed by withdrawing the pistons of the clamping and centralizing piston and cylinder units and by means of ropes 16, raising the system 22 up out of the ground hole 20.

Although the invention has been described in considerable detail with respect to preferred embodiments thereof, it will become apparent that the invention is capable of numerous modifications and variations, apparent to those skilled in the art, without departing from the spirit and scope of the invention.

I claim:

1. An apparatus for centrally installing a shoring column into a predrilled ground hole, comprising:

a ring-shaped supporting structure having an outside diameter slightly smaller than the diameter of the drilled ground hole, and having a central opening therethrough of a diameter larger than the cross section of the shoring column, clamping means attached to the interior of the ring-shaped supporting structure and including diametrically opposed clamping elements movable towards each other to clamp a column positioned therebetween, and a plurality of centralizing piston and cylinder units attached to the interior of the ring-shaped supporting structure and extendable radially outwardly therethrough, such that when extended they engage the side of the ground hole to centralize the column therein, and remote control means for controlling the clamping means and piston and cylinder units from a location exterior to the ground hole.

2. An apparatus according to claim 1, said piston and cylinder units being hydraulic.

3. An apparatus according to claim 2, including hydraulic and electrical lines interconnecting said remote control means with said clamping and piston and cylinder means.

4. An apparatus according to claim 1, including a first set of piston and cylinder units for preliminary central adjustment of the supporting structure and a second set of piston and cylinder units for fine central adjustment of the supporting structure.

5. An apparatus according to claim 4, wherein there is an odd number of piston and cylinder units within each set.

6. An apparatus according to claim 1, said clamping means comprising a positive stop on one side of the column, and a piston and cylinder unit opposing it on the other side of the column.

7. An apparatus according to claim 6, wherein the positive stop is adjustably mounted on the supporting structure for adjustable movement towards and away from the column.

8. An apparatus according to claim 1, including an operating platform attached to the interior of the ring-shaped supporting structure and extending radially inwardly therefrom, said clamping means and said centralizing piston and cylinder units connected to said platform.

9. An apparatus according to claim 8, including a first set of at least three centralizing piston and cylinder units mounted on the top of said platform and a second set of at least three centralizing piston and cylinder units mounted on the bottom of said platform.

10. A method of installing a prefabricated shoring column comprising the steps of:

drilling a predrilled ground hole, placing a foundation compound in the ground hole, using a clamping device on an installation apparatus, attaching an installation apparatus onto the prefabricated shoring column and lowering the prefabricated shoring column into the ground hole until the installation apparatus is in the hole and the lower end of the shoring column is within the foundation compound, and using piston and cylinder units mounted on the installation apparatus, centralizing the shoring column within the ground hole.

11. A method according to claim 10, including controlling the clamping device and the centralizing piston and cylinder units remotely from a location outside of the ground hole.

* * * * *